United States Patent [19]

Nelson

[11] 4,152,886

[45] May 8, 1979

[54] PROCESS FOR MAKING YARN HAVING ALTERNATE SECTIONS OF GREATER AND LESS BULK AND PRODUCT THEREOF

[75] Inventor: Thomas L. Nelson, Georgetown, Del.

[73] Assignee: E. I. Du Pont de Nemours and Company, Wilmington, Del.

[21] Appl. No.: 858,199

[22] Filed: Dec. 7, 1977

Related U.S. Application Data

[63] Continuation-in-part of Ser. No. 772,865, Feb. 28, 1977, abandoned.

[51] Int. Cl.[2] ..... D02G 1/16; D02G 3/24; D02G 3/34

[52] U.S. Cl. ..... 57/208; 28/252; 28/271; 57/350

[58] Field of Search ..... 57/139, 140 R, 140 BY, 57/140 J, 34 B, 34 HS, 34 R, 157 R, 157 TS, 157 S, 157 MS, 157 F; 28/252, 253, 254, 271-276, 281

[56] References Cited

U.S. PATENT DOCUMENTS

| | | | |
|---|---|---|---|
| 2,435,891 | 2/1948 | Lodge | 57/34 B X |
| 3,103,098 | 9/1963 | Dyer | 57/34 B X |
| 3,110,151 | 11/1963 | Bunting et al. | 57/34 B X |
| 3,332,125 | 7/1967 | Davis et al. | 57/34 B X |
| 3,417,445 | 12/1968 | Gemeinhardt et al. | 57/140 J X |
| 3,577,615 | 5/1971 | LeNoir | 28/271 |
| 3,703,753 | 11/1972 | Binford | 28/271 X |
| 3,852,946 | 12/1974 | Smith et al. | 57/157 F X |
| 3,946,548 | 3/1976 | Hino et al. | 57/140 J |
| 3,977,173 | 8/1976 | Kosaka et al. | 57/157 TS X |
| 4,025,994 | 5/1977 | Phillips | 57/157 F X |
| 4,033,103 | 7/1977 | Vukoje | 57/140 J X |
| 4,051,660 | 10/1977 | Griset | 57/140 BY |
| 4,064,686 | 12/1977 | Whittel et al. | 57/140 J |
| 4,070,815 | 1/1978 | Negishi et al. | 28/252 X |
| 4,115,988 | 9/1978 | Nakagawa et al. | 57/140 J X |

FOREIGN PATENT DOCUMENTS

| | | | |
|---|---|---|---|
| 484219 | 1973 | Japan | 28/252 |

*Primary Examiner*—Donald Watkins

[57] ABSTRACT

A bulked continuous multi-filament nylon yarn is intermittently debulked by passing a stream of heated gas through the yarn while it is under tension. The product comprises a bulked continuous filament yarn having adjacent sections of greater and less bulk with nodes of interlaced filaments between each section.

16 Claims, 6 Drawing Figures

PROCESS FOR MAKING YARN HAVING ALTERNATE SECTIONS OF GREATER AND LESS BULK AND PRODUCT THEREOF

CROSS REFERENCE TO RELATED APPLICATION

This application is a continuation-in-part of copending application Ser. No. 772,865, filed Feb. 28, 1977 and now abandoned.

BACKGROUND OF THE INVENTION

This invention relates to a bulked continuous filament nylon yarn and in particular to a process for producing bulked continuous filament nylon yarn having adjacent sections of different bulk levels with improved coherency.

Synthetic continuous filament yarns which have been intermittently bulked along their length are well known. Various bulking methods have been employed such as false-twist crimping, stuffer-box crimping, edge crimping, and jet crimping, each of the bulking methods being applied to the yarn intermittently so as to leave certain lengths of yarn unbulked. Where heat is used for bulking, such processes not only create contrasts in bulk between the bulked and unbulked zones but also differences in luster and dyeability, the heated bulked zones conventionally having deeper dyeability due to the relaxation which takes place. It is also known to reduce or remove bulk or latent bulk development potential intermittently from a previously bulked yarn by intermittently pressing a bulked yarn under tension against a heated shoe, or by treating various types of bulked yarns intermittently with a swelling agent and then passing such treated yarn under tension through a heating zone to release the bulk in the treated parts of the yarn. However, when yarns are intermittently debulked before being made into a fabric, the filaments in the debulked zone have little entanglement and cohesion and are likely to snag when being used in fabric-making operations causing operating difficulties and fabric defects. Therefore, a rapid continuous method of intermittently reducing or removing bulk development capability from the filaments of bulked yarns and at the same time introducing sufficient coherency for adequate handling is highly desirable.

One method for providing a coherent multi-filament yarn is taught by Bunting and Nelson in their U.S. Pat. No. 3,110,151. According to the patent interlaced yarn is produced by passing a multifilament strand or plurality of strands, under a controlled positive tension sufficient to prevent formation of ring-like loops, through a fluid jet which separates filaments and groups of filaments from each other and then randomly intermingles them.

SUMMARY OF THE INVENTION

It has now been found that an intermittently debulked continuous filament nylon yarn with improved filament cohesion in the debulked sections may be made by passing a pressurized high velocity stream of heated fluid through spaced apart portions of a bulked continuous filament thermoplastic yarn, esp. nylon, moving under tension in such a manner that the heated fluid debulks predetermined sections of the yarn and interlaces the filaments in the debulked sections. The product is a bulked continuous filament nylon yarn having a repeating pattern comprising a first section having one level of bulk adjacent a second section having a different level of bulk, the section with the lower level of bulk having tightened portions at its opposite ends. The tightened portions are characterized as nodes of interlaced filaments or by a combination of nodes of interlaced filaments with filaments encircling the nodes.

Any heated fluid substantially inert to the yarn may be employed in the process of this invention, and steam is preferred.

A particular advantage for the use of high velocity heated fluid is that it opens the yarn bundle, forms nodes of interlace in the debulked sections to improve coherency of the yarn and treats all filaments in the yarn bundle reasonably uniformly in distinction to the prior art arrangements which use hot shoes or other means that heat the surface filaments of the yarn bundle more than those in the center of the yarn bundle and further, the prior art devices do not function to intermittently debulk an already bulked yarn and form interlace nodes in the debulked sections of the yarn.

Tufted loop and cut pile fabrics made from the yarn of this invention reflect light to provide unique highlighting effects in the fabric because of dissimilar light reflecting characteristics between sections of different bulk levels.

DETAILED DESCRIPTION OF THE PREFERRED EMBODIMENT

Figure 1:
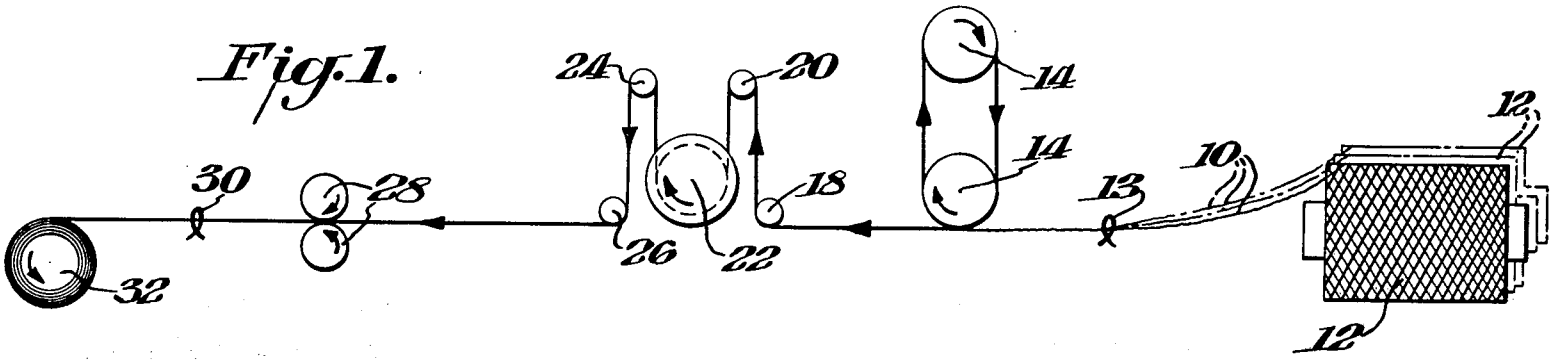
FIG. 1 is a schematic illustration of a preferred embodiment of a process and apparatus for preparing the yarn of this invention.

Referring now to FIG. 1, a bulked continuous filament nylon yarn 10 is withdrawn from package 12 by means of two driven rolls 14 acting in tandem and slightly skewed to one another so that multiple wraps of yarn may be taken on the two rolls to prevent slippage. If desired, multiple ends of yarn 10 may be taken from packages 12 and brought together in guide 13 ahead of rolls 14. If desired, rolls 14 may be heated by placing them within a chest to which heated air is introduced. The yarn would then be preheated as it contacts rolls 14. After leaving rolls 14 the yarn then passes over guide rollers 18, 20 and takes approximately a 180 degree wrap around driven wheel 22 used for passing steam through spaced apart portions of the yarn. The yarn leaves wheel 22 over guide rolls 24, 26 and passes through a pair of driven nip rolls 28, a guide 30, and is wound up on package 32. The speed of rolls 28 is regulated with respect to the speed of rolls 14 to tension the yarn 10 at a desired level in the range of 0.01 to 0.1 grams per denier while it is being treated in passing around wheel 22. The speed of windup on package 32 is regulated with respect to rolls 28 to establish desired tension for winding a satisfactory package.

Figure 3:
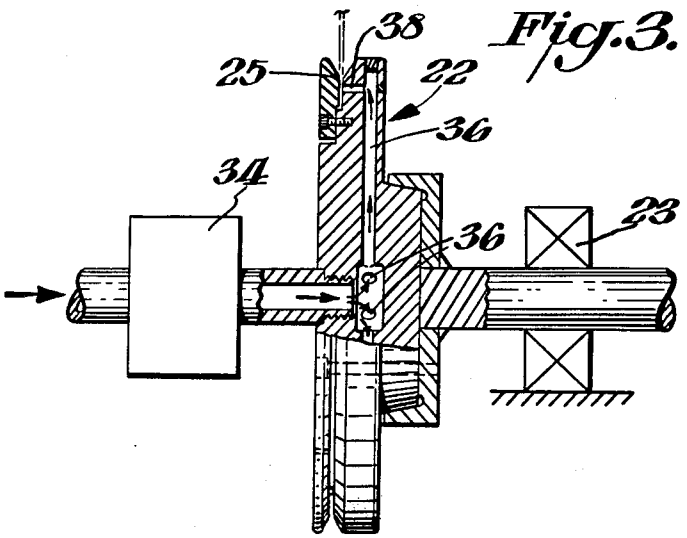
FIG. 3 is a partially sectioned side elevation of FIG. 2 taken along line 3—3.
Figure 2:
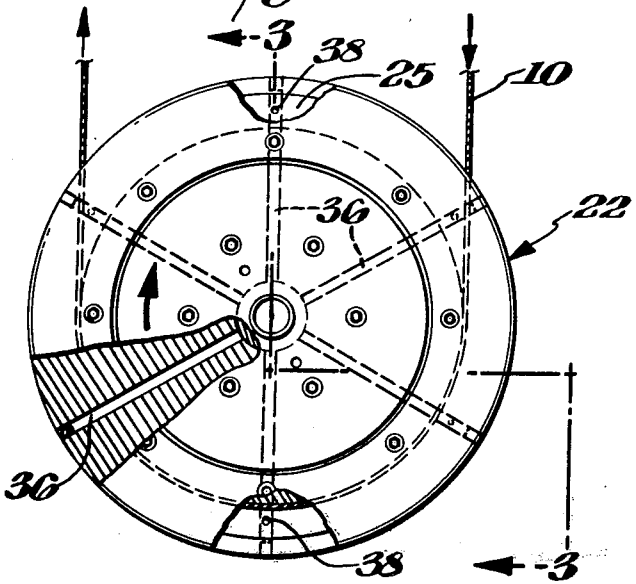
FIG. 2 is an enlarged front elevation partially broken away of the apparatus for passing heated pressurized fluid through the yarn.

FIGS. 2 and 3 show heat-treating wheel 22 supported in a bearing 23 for turning about its axis. Yarn 10 enters groove 25 and is held in the bottom of the groove during its 180° wrap by suitable tension in the yarn as developed between rolls 14 and 28. Steam is fed to wheel 22 through a rotary packing gland 34 on its axis and travels through passages 36 in wheel 22 to holes 38. As the wheel rotates, the steam from a hole 38 will cut across the path of yarn 10, at about the same location on the yarn as the yarn enters and leaves the groove 25 when the wheel is traveling at the same speed as the yarn.

The wheel 22 may either be driven by the yarn at yarn speed or may be separately driven. In the latter case, the wheel speed may either be the same as the yarn speed or may be slightly less or greater. Such differential movement can increase the length of debulked sections. Ratios between the wheel speed and the yarn speed are preferably about 0.9-1 to 1.1-1. Ratios outside this range could result in excessive rubbing.

It should be recognized that different debulking patterns may be obtained by selectively plugging passages 36.

Figure 4:
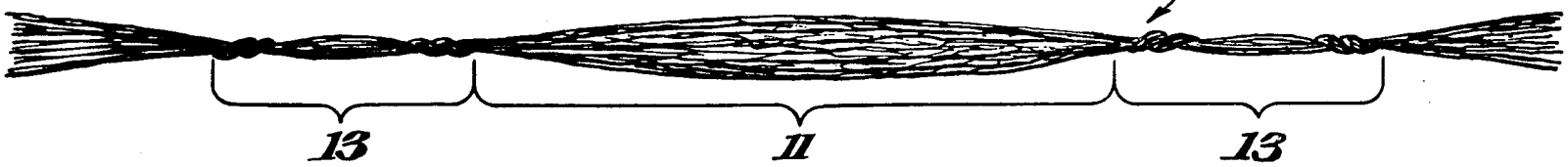
FIG. 4 is a schematic view of the yarn of this invention showing adjacent sections of different bulk levels with tightened portions at opposite ends of the sections of lower bulk.
Figure 5:
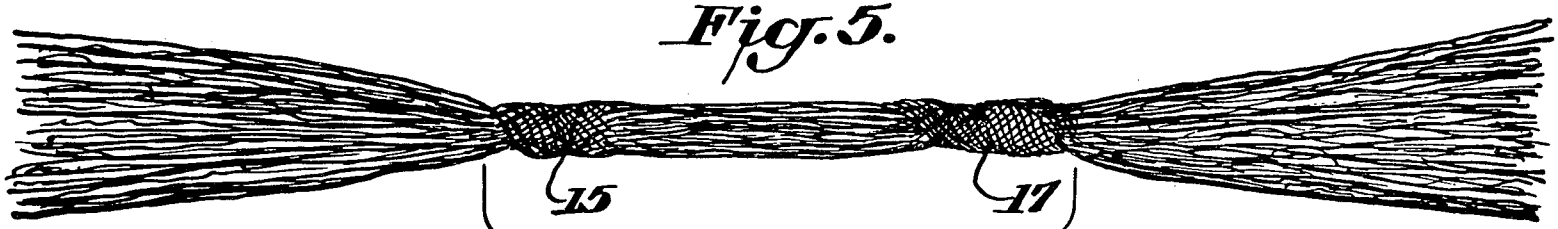
FIG. 5 is an enlarged view of a portion of the yarn of FIG. 4 showing the tightened portions as interlace nodes.
Figure 6:
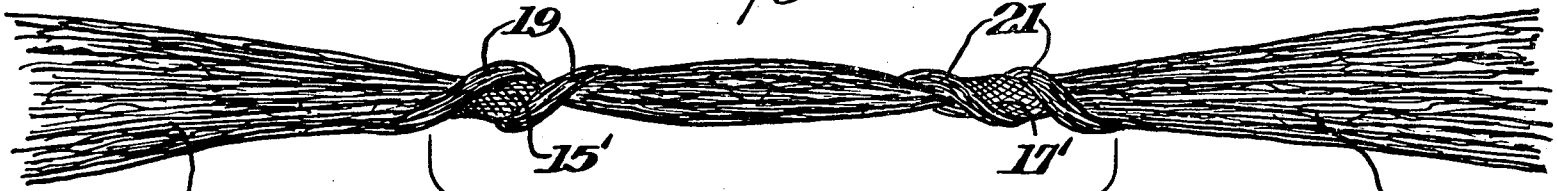
FIG. 6 is an enlarged view of another portion of the yarn of FIG. 4 showing the tightened portions as interlace nodes encircled by groups of filaments.

In operation, steam from holes 38 cuts across the path of yarn 10 and the filaments are separated, interlaced and heated uniformly by the steam to remove their bulk tendency and remain in contact with the steam at this location during 180 degrees of wheel rotation. The resultant product as shown in FIGS. 4–6 is a bulked continuous filament nylon yarn 10′ having a repeating pattern comprising a first section 11, having one level of bulk adjacent a second section 13 having a different level of bulk. In FIG. 4 section 13 has the lower level of bulk and as more clearly seen from FIG. 5 section 13′ has tightened portions 15, 17 at its opposite ends. These tightened portions may comprise nodes of interlaced filaments as in FIG. 5 or nodes of interlaced filaments 15′, 17′ encircled by groups of filaments 19, 21, respectively, as in FIG. 6.

While there may be multiple interlace nodes in long sections of lower bulk, there is a tightened portion at the beginning and end of a section of lower bulk. The tightened portions at each end of the debulked portions 13, 13′ improve the coherency of the yarn 10.

The yarns of the invention which have been boiled in a relaxed state develop bulk in the sections 11, to a greater extent than that in the heat-treated debulked sections 13, 13′ and the degree of bulk in sections 13, 13′ may vary from slightly less than a fully bulked yarn to a completely unbulked yarn, depending upon degree of treatment.

A primary feature of yarn of the invention in woven, knitted, tufted loop and tufted cut pile fabrics is the different light reflecting values of the bulked versus debulked sections. This feature is especially apparent in tufted looped and cut pile carpet fabrics when viewed in normal overhead lighting conditions. The two carpet constructions, however, differ greatly in the way the light is reflected. In loop construction, when a debulked section coincides with the "arch" portion of the tuft, a bright luster highlight is observed as the room light is reflected more or less specularly. This highlight is accentuated by the diffuse light reflection of the surrounding bulked loop "arches." In cut pile constructions, the bulked tufts, with their "balled-up" tip configuration, are an effective diffuse reflection source. The debulked tufts, with their close packed substantially straight filament array and planar cut tip geometry, appear to "pipe" some of the light away from the surface and scatter it down the length of the tuft. The result is that the debulked tufts appear much darker than the bulked tufts when viewed from the end of the tuft. The phenomenon is observed with both single and multi-dyeability source yarns and in both sheared and unsheared cut pile. A further styling possibility is seen when yarns of the invention are used in high-low loop pile construction and only the higher loops are cut or sheared.

It has been found that the dyeability of the yarn in the debulked sections is not greatly different from that in the bulked sections, being generally higher, but the higher luster of the debulked sections when seen from the side gives an appearance of lighter dyeability. When seen from the end of cut pile, however, the effect is much darker as described previously.

The process may either be performed as a separate operation on yarn previously bulked or it may be coupled to the bulking operation disclosed by Williams in U.S. Pat. No. 3,271,943 as an additional step following the bulking operation and before winding.

Depending upon the yarn temperature and tension, various degrees of bulk removal may be obtained. Very high temperatures may cause fusing of the filaments and for normal carpet purposes should be avoided. When very high speeds are employed, it may be necessary to preheat the entire yarn but to a temperature insufficient to debulk the bulky sections so that the hot jetted debulking fluid will only have to raise the temperature of the filaments above the threshold necessary to provide the debulking action. In the case where this debulking operation follows immediately after a hot bulking process, the yarn temperature as it approaches the intermittent debulking stage may be high enough to eliminate the need for preheating.

Depending on factors mentioned above the preheating step may be carried out at temperatures ranging from 45° C. to about 210° C., most frequently at temperatures of 75° C. to 210° C. The temperature of the heated fluid jetted on the yarn may be from about 150° C. to about 300° C., preferably at temperatures of 240° C. to 300° C. The heated fluid will normally be under a pressure of from about 50 pounds per square inch to about 200 pounds per square inch; most frequently at a pressure of from 70 to 125 pounds per square inch.

The tension in the yarn during heating may vary over a substantial range, depending on the degree to which crimp recovery is to be suppressed and the cohesion desired. For example, low tension may actually allow a controlled amount of crimp to develop and be heat set in that form so that there will be little further development of crimp during fabric finishing. Tensions may range from 0.01 grams/denier up to the yield point of the yarn, preferably the tensions range from 0.01 grams/denier to about 0.1 grams/denier. Tension and fluid pressure govern the degree of interlacing obtained, high tensions inhibiting interlace and high fluid pressure increasing it. The degree of bulk present in the filaments at the time of interlacing also affects interlacing efficiency, high degrees of bulk inhibiting interlacing.

While the lengths of the bulked and debulked sections may vary with the intended end use and styling effects desired, a yarn to be used in a loop or cut pile fabric, should not have excessively short bulked or debulked sections. Obviously, if such sections were shorter than the pile height, some of them might be hidden in the backing. Similar considerations will apply to lighter denier yarns used for knitting. The maximum length is governed only by the frequency with which a repeat is desired. For many fabrics, a regular spacing is undesirable and, therefore, an irregular pattern may be produced by uneven spacing of holes in the wheel of FIGS. 2 and 3 or by programming the speed of the wheel 22.

As a general criterion, lengths of the debulked sections may range from about ¼" to about 10 inches while the bulky sections may range in length from about ½" to about 10". In most cases the length of the bulky section should be selected to be equal to or greater than the length of the debulked sections.

In the following examples, single or multiple ends of bulked 6—6 nylon yarn 10 are taken from packages 12 and are brought together through a guide and fed through equipment substantially as shown in FIG. 1. Feed rolls 14 are enclosed in a chest, the temperature of which can be regulated by controlling the temperature of air admitted to the chest. The temperature within the chest will be called the pre-heat temperature.

Wheel 22 is as shown in FIGS. 2 and 3 but the dimensions of wheels used on different examples were as follows: Wheel A, 3 orifices 38 at 120° radial spacing, the orifice centers being located on a diameter of 3.82 inches (97 mm); Wheel B, orifices 38 at 60° radial spacing, centers on 3.82 inch (97 mm) diameter circle; Wheel C, 24 orifices 38 at 15° radial spacing on 7.64 inch (194 mm) diameter circle. Passages 36 feeding each orifice may be plugged or unplugged to select a desired pattern.

Three different patterns were used on Wheel C as follows:

| Pattern | Pressurization Arrangement* |
|---|---|
| F | XXXOXXXOXXXOXXXOXXXOXXXO |
| G | OOOOOOOOOOOOXXXXXXXXXXXX |
| H | OXXOXXXOXXXXXOXOXXXXXXXX |

*X = plugged, O = unplugged

The process conditions and lengths of high-bulk versus lower bulk in the yarns produced are shown in Table I below:

TABLE I

| Example | I | II | III | IV | V | VI | VII | VIII | IX | X |
|---|---|---|---|---|---|---|---|---|---|---|
| Supply Yarn (6-6 nylon) | 1 end 1225d 68 fil cationic dye* 1 end 1225d 68 fil light dye* 1 end 1245d 83 fil deep dye* | 1 end 2450d 136 fil deep dye* | 1 end 500d 92 fil 2.3 MR trilobal regular dye | 3 ends 1300d 68 fil 2.3 MR trilobal deep dye | Same as Ex. I | Same as Ex. IV | Same as Ex. IV | Same as Ex. IV | Same as Ex. IV | Same as Ex. IV |
| Rolls 14-Speed (ypm) | 302 | 103 | 300 | 300 | 500 | 500 | 1000 | 500 | 500 | 500 |
| (mpm) | 276 | 94 | 274 | 274 | 457 | 457 | 914 | 457 | 457 | 457 |
| No. Wraps | 10 | 6 | 6 | 7 | 10 | 10 | 10 | 10 | 10 | 10 |
| Preheat Temp. (°C.) | 150 | 45 | 45 | 55 | 170 | 175 | 210 | 175 | 175 | 175 |
| Wheel 22 | | | | | | | | | | |
| Type | C | A | A | B | C | C | C | C | C | C |
| Pattern | F | 3 holes open | One hole open | 6 holes open | G | H | F | F | F | F |
| Slot width - (in) | 0.10 | 0.08 | 0.08 | 0.08 | 0.10 | See Ex. V | See Ex. V | See Ex. V | See Ex. V | See Ex. V |
| - (mm) | 2.54 | 2.03 | 2.03 | 2.03 | 2.54 | | | | | |
| Hole 38 dia - (in) | 0.093 | 0.093 | 0.093 | 0.062 | 0.093 | | | | | |
| - (mm) | 2.36 | 2.36 | 2.36 | 1.57 | 2.36 | | | | | |
| RPM | 495 | 337 | 1000 | 900 | 750 | 750 | 1500 | 750 | 750 | 750 |
| Wheel/Yarn Vel. Ratio | 1.1/1 | 1.1/1 | 1.1/1 | 1/1 | 1/1 | 1/1 | 1/1 | 1/1 | 1/1 | 1/1 |
| Steam Pressure | | | | | | | | | | |
| (psig) | 125 | 115 | 100 | 100 | 70 | 75 | 100 | 75 | 75 | 75 |
| (kg/cm²) | 8.75 | 8.05 | 7.0 | 7.0 | 4.9 | 5.25 | 7.0 | 5.25 | 5.25 | 5.25 |
| Steam Temp. (°C.) | 260 | 250 | 250 | 270 | 275 | 280 | 290 | 240 | 260 | 280 |
| Tensions | | | | | | | | | | |
| Treating zone (gms per denier) | .05 | .035 | .050 | .057 | .07 | .038 | .08 | .050 | .050 | .064 |
| Winding (gms) | 125 | 125 | 100 | 125 | 125 | 125 | 125 | 125 | 125 | 125 |
| Lengths | | | | | | | | | | |
| High Bulk (in) | 1.6 | 1.6 | 6.6 | 1.1 | 10.4 | ** | 2.2 | 2.2 | 2.2 | 2.2 |
| (cm) | 4.2 | 4.2 | 16.7 | 2.8 | 26.5 | | 5.6 | 5.6 | 5.6 | 5.6 |
| Lower Bulk (in) | 1.3 | 1.3 | 1.2 | 0.5 | 10.2 | ** | 1.1 | 1.1 | 1.1 | 1.1 |
| (cm) | 3.4 | 3.4 | 3.1 | 1.3 | 25.9 | | 2.8 | 2.8 | 2.8 | 2.8 |

*4 void filament cross-section per U.S. 3,745,061.
**See Table II

TABLE II

Yarn of Example VI has an irregular pattern within one wheel revolution, which repeats at each revolution, as follows:

| | High Bulk | Low Bulk | High Bulk | Low Bulk | High Bulk | Low Bulk | High Bulk | Low Bulk | High Bulk | Low Bulk |
|---|---|---|---|---|---|---|---|---|---|---|
| in | 6.4 | 0.85 | 1.66 | 0.87 | 2.46 | 0.94 | 4.0 | 0.98 | 0.89 | 0.83 |
| cm | 16.3 | 2.16 | 4.21 | 2.20 | 6.25 | 2.38 | 10.16 | 2.49 | 2.26 | 2.10 |

Yarns of all examples exhibit a repeating pattern of a first section of one level of bulk adjacent a second section of a lower level of bulk with the section of lower level of bulk having tightened portions at its opposite ends. The tightened portions usually are interlace nodes with single or multiple filament wrap arounds similar to FIG. 6. However, in some instances the tightened portions only indicate interlace nodes as in FIG. 5.

Yarn of Example I is tufted into a 3/16" gauge, 7¼ stiches per inch, ⅝" pile height, 35 ozs/yd² cut pile fabric. Visual contrast between the cut ends of the cut loops of bulky sections and treated sections is startling. Light reflecting off the crimps in the bulky sections gives a light appearance to these ends. However, where a treated section is cut the filaments are substantially straight so that little light reflects to the observer and these ends appear very dark.

Yarn of Example III is made into a sweater by circular knitting. The lower bulk sections have a firm feel compared to the soft high-bulk sections. The low bulk sections show a luster pattern which simulates patterned knitting due to the patterns repeating in adjacent knit rows. Such patterns may be varied by selecting different high and low bulk patterns and various knitting conditions. A similar yarn when used as filling in woven upholstery fabric gives an effect similar to thick and thin yarn.

Yarns of the other Examples are made into loop and cut pile carpet in constructions suitable to their various deniers. All exhibit the bulk and luster contrasts discussed above but with differences in the degree of contrast and the amount of high or low bulk visible.

Examples VIII, IX, and X show the effects of steam temperature and/or tension on the degree of debulking obtained in treated sections compared to the bulk in the higher bulk untreated sections. The degree of debulking obtained in Example VIII is about the minimum which will give a noticeable bulk and/or luster difference in either cut or loop pile fabric. Example X shows approximately maximum amount of debulking while Example IX lies between the two extremes. Although the filament length difference of about 17% shown in Example VIII is the minimum needed to give a useful degree of bulk and/or luster contrast in any pile fabric, at least 20% filament length difference is preferred.

The yarn of Example VIII is characterized as having the following pattern description:

(1) A 2-inch length of high bulk. The three supply yarn ends are separate and parallel.

(2) A tight interlace node approximately ⅛" long. The node usually contains single and/or multiple filament "wrap-arounds." The filaments in the node appears to retain some filament crimp. The luster of the node is not markedly different from the high bulk section.

(3) A ¾" section of intermingled crimped filaments that shows substantially the same luster when viewed from the side but noticeably less bulk than the high bulk section. The lower bulk section appears as a single end, indicating a high level of blending of the three supply yarns.

(4) A tight interlace node that is a mirror image of (2) above.

If one or more of the three supply yarns are of different dyeability, the finished yarns after processing and dyeing will exhibit distinct parallel sections of separated colors in the higher bulk regions and blended heather tones in the regions of lesser bulk. Different degrees of blending may be obtained by varying the process parameters.

The pattern description of the yarn of Example VIII applies to the yarn of Example IX with the exception that the 260° C. steam temperature caused considerable more filament decrimping to occur, resulting in a noticeable luster contrast between the treated section and the untreated section.

The pattern description of the yarn of Example X is the same as that of Example IX except that the 280° C. steam temperature caused still more filament decrimping, resulting in a substantial luster contrast between the treated section and the untreated section.

To determine the actual percent change in filament length in the treated sections versus the untreated sections, a test was devised in which ½" lengths of boiled-off treated and untreated filaments were photographed in a tensionless state by a Bell and Howell Microfiche Unit. The optical system of the unit magnified the filaments 18X. Each filament was then measured linearly by a Keuffel and Esser No. 62 0300 map measuring instrument. Fifty filaments were selected at random from the treated sections of each test items and twenty filaments at random from the untreated sections of each test item. The lengths were as shown in Table III below.

TABLE III

| Item | High Bulk Section, in | Lower Bulk Section, in | % Decrease |
|---|---|---|---|
| Ex. VIII | 11.98 | 9.93 | 17.1 |
| Ex. IX | 12.41 | 9.25 | 25.5 |
| Ex. X | 12.06 | 9.14 | 24.2 |

Examination of mirror boards and loop style carpets clearly demonstrate the luster differences between the items. It is noteworthy that the incremental change in filament "straightness" of Example X due to removal of microcrimp creates a dramatic increase in luster contrast level as compared with Example IX, which has some microcrimp in the filaments.

The interlace in the debulked sections of the yarn of Example X was measured by the hook drop method disclosed in Bunting and Nelson U.S. Pat. No. 2,985,995 using a hook with 100 grams weight and the averge coherency factor was found to be 107. This level is quite adequate to prevent snagging etc. for all normal processing.

What is claimed is:

1. A bulked continuous filament nylon yarn composed of individually crimped filaments having a repeating pattern comprising a first section having one level of bulk adjacent a second section having a different level of bulk, the section with the lower level of bulk having fewer crimps per unit length and nodes of interlaced filaments at its opposite ends.

2. The yarn as defined in claim 1, said nodes of interlaced filaments being encircled by a group of filaments.

3. A process for treating a bulked continuous filament yarn composed of individually crimped filaments moving from a source to a windup comprising the steps of: tensioning the yarn between the source and windup; and intermittently passing a heated fluid under pressure through spaced apart portions of the tensioned yarn to reduce the number of crimps per unit length in said portions.

4. The process as defined in claim 3, including the step of preheating the yarn to a temperature of from about 75 to about 210 degrees centigrade before intermittently passing the heated fluid through it.

5. The process as defined in claim 3, said fluid being heated to a temperature of from about 150 to about 300 degrees centigrade.

6. The process as defined in claim 5, said heated fluid being under a pressure of from about 50 to about 200 pounds per square inch.

7. A tufted loop pile fabric wherein the pile yarn is the yarn of claim 1.

8. A tufted cut pile fabric wherein the pile yarn is the yarn of claim 1.

9. A bulked continuous filament nylon yarn composed of individually crimped filaments having a repeating pattern comprising alternate sections having greater and less crimps per unit length and having a node of interlaced filaments between each section.

10. The yarn as defined in claim 9 in which the nodes of interlaced filaments are encircled by a group of filaments.

11. The yarn as defined in claim 9 in which the sections of less crimps per unit length range in length from ¼ inch to about 10 inches in length, the sections of greater bulk range in from ½ to about 10 inches in length and the length of the sections of greater bulk are equal to or longer than the sections of less bulk.

12. A process for treating a bulked continuous filaments nylon yarn composed of individually crimped filaments moving from a source to a windup comprising the steps of: tensioning the yarn between the source and the windup, and passing the tensioned yarn around a wheel having means for passing a heated fluid under pressure through the yarn at predetermined points in the yarn as it passes around the wheel to reduce the number of crimps per unit length at said predetermined points, the speed ratio between the wheel and the yarn being 0.9:1 to 1:1 to 1.

13. The process as defined in claim 12 said heated fluid under pressure being steam at a temperature of from about 150° C. to about 300° C. under a pressure of from about 50 to about 200 pounds per square inch.

14. The process as defined in claim 13, said temperature being in the range of from 240° C. to 300° C. and said pressure being from 75 to 125 pounds per square inch.

15. The process as defined in claim 12, the force of tensioning the yarn being in the range of from about 0.01 to about 0.1 grams per denier.

16. The process as defined in claim 12, including the step of heating the yarn to a temperature of from about 45° C. to about 210° C. before pressing it around the wheel.

* * * * *